United States Patent [19]

Collura

[11] 4,227,469

[45] Oct. 14, 1980

[54] MULTIPURPOSE SLAG SYSTEM

[76] Inventor: Frank Collura, 2926 W. Jean St., Tampa, Fla. 33614

[21] Appl. No.: 936,183

[22] Filed: Aug. 23, 1978

[51] Int. Cl.[2] ..... F23J 1/00

[52] U.S. Cl. ..... 110/171; 110/165 R

[58] Field of Search ..... 110/165 R, 165 A, 171; 65/19; 126/242

[56] References Cited

U.S. PATENT DOCUMENTS

| | | | |
|---|---|---|---|
| 2,693,776 | 11/1954 | Mylting | 110/165 R |
| 3,397,657 | 8/1968 | Tada | 110/165 A X |
| 3,741,136 | 6/1973 | Stookey | 110/165 R |

FOREIGN PATENT DOCUMENTS

| | | | |
|---|---|---|---|
| 605817 | 9/1960 | Canada | 110/165 R |
| 1098141 | 1/1961 | Fed. Rep. of Germany | 110/165 R |

*Primary Examiner*—Edward G. Favors

*Attorney, Agent, or Firm*—Clarence A. O'Brien; Harvey B. Jacobson

[57] ABSTRACT

A slag removal system for wet bottom boilers is provided wherein tandem tap holes are provided. The first hole comprises a vertical hole to be selectively closed by damming and the second hole comprises a horizontal hole and is dammed or sealed with sand in order to seal against the passage of boiler gases through the tap holes. In addition, multi-compartment slag tanks are provided and each slag tank may be selectively placed into and taken out of service, as desired. Further, an alternate type of slag tank is disclosed wherein a suitable cooled bed of slag particles is provided on a turntable and the tapped molten slag is deposited onto a peripheral portion of the turntable as the latter is rotated and a breaker is provided for breaking up the resultant ribbon of solidified slag at predetermined intervals.

22 Claims, 9 Drawing Figures

MULTIPURPOSE SLAG SYSTEM

BACKGROUND OF THE INVENTION

There are many systems for removing molten slag from wet bottom boilers. Most of these systems utilize horizontal tap holes (parallel to the boiler floors). Molten slag flows through these tap holes and into water filled tanks, which by the chilling effect of cool water causes the molten slag to solidify and disintegrate into a course granular product. The resultant black slag particles are discharged hydraulically at regular intervals from the slag tanks.

However, due to the load changes, combustion conditions or the type of coal the boiler is fueled with, the molten slag sometimes tends to thicken and become "gummy" causing the tap holes to close. This creates a most serious problem and many man-hours of labor are presently spent in reopening closed horizontal tap holes to insure maintaining a boiler in service.

Examples of various forms of slag removal systems previously known are disclosed in the following U.S. patents:

U.S. Pat. Nos. 545,001—Aug. 20, 1895—VanCleve et al.; 2,149,688—Mar. 7, 1939—Schott; 2,548,656—Apr. 10, 1951—Dolezal; 2,667,848—Feb. 2, 1954—Silk; 3,133,804—May 19, 1964—Hardgrove; 3,395,995—Aug. 6, 1968—Burch; 3,741,136—June 26, 1973—Stookey.

SUMMARY OF THE INVENTION

The main object of this invention is to provide a slag removal system which will substantially reduce the existence of dangerous conditions which occur when slag tap holes become clogged.

Another object of this invention is to provide an improved slag removal system constructed in a manner whereby slag tank explosions resulting in excessive damage to plant machinery and injury to personnel may be substantially eliminated.

Still another object of this invention is to provide a slag removal system which will be operative to transform slag into a more useful by-product instead of a now known waste product. Chilled solidified slag particles are used mainly for sand blasting and are added to concrete aggregate and mixed with road building asphalt products.

Another important object of this invention is to provide a slag removal system which may be operated to control the slag tapping operation with greater effectiveness to thereby enable improved by-product production of various thickness and sizes of slag particles which may be used for drain fields, solar collector heat sinks, or a substitute for pebbles, rocks and stones, as well as other uses to be subsequently realized as a result of the availability of controlled size slag particle formation.

A final object of this invention to be specifically enumerated herein is to provide an improved multi-purpose slag removal system in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
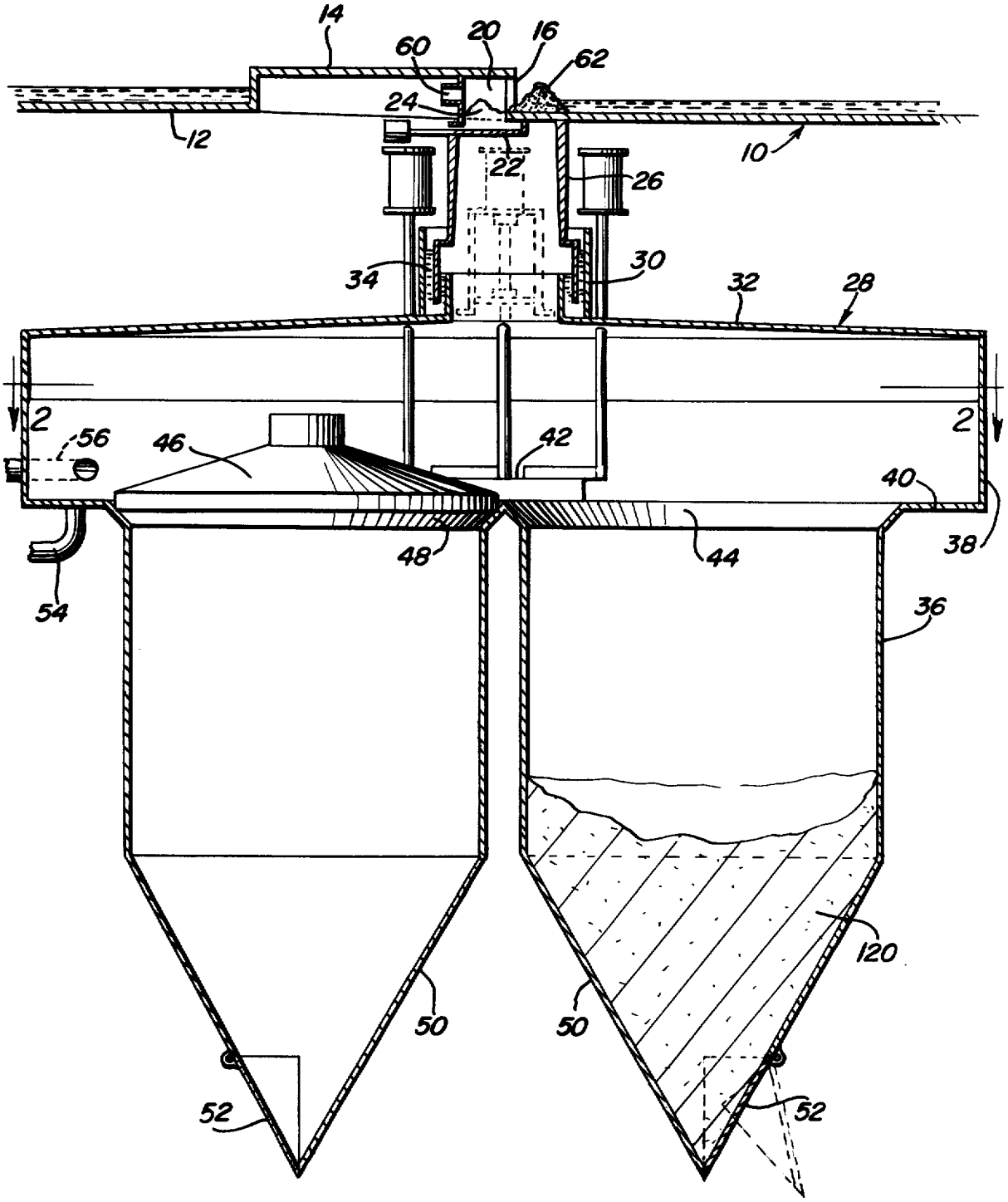
FIG. 1 is a fragmentary, vertical sectional view of the floor of a wet bottom boiler and with a first form of multi-purpose slag removal system of the instant invention operatively associated therewith.
Figure 2:
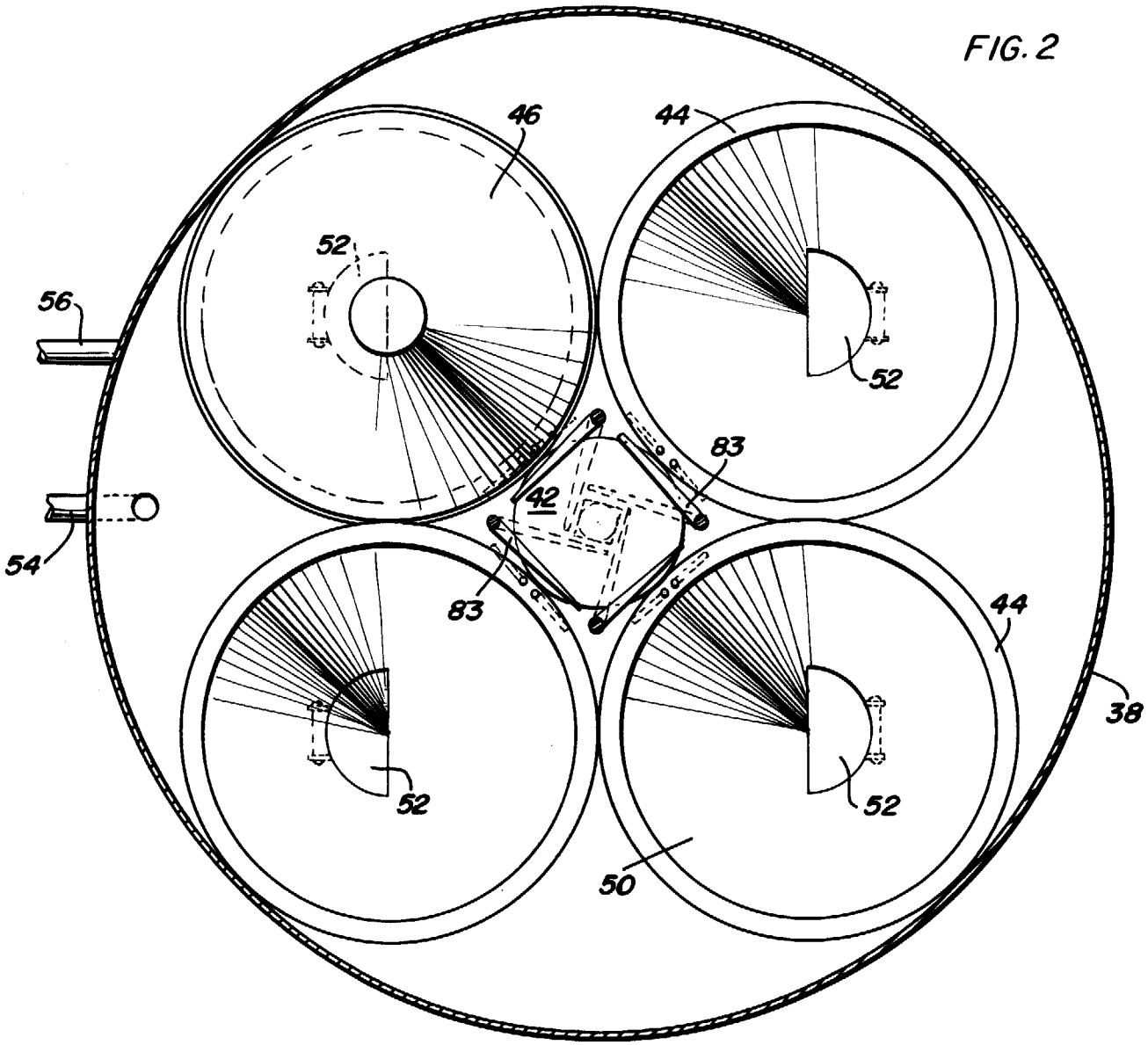
FIG. 2 is a horizontal sectional view taken substantially upon the plane indicated by the section line 2—2 of FIG. 1.

Referring now more specifically to the drawings, the numeral 10 generally designates a wet bottom boiler whose bottom 12 includes a raised portion 14 defining a vertical tap hole 16 toward which the bottom 12 slopes. The vertical tap hole 16 opens horizontally into a compartment 20 disposed below the raised portion 14 and the compartment 20 is selectively closeable at its lower end by means of a pivoted and counterbalanced gate 22 which may be water cooled and have sand or chilled solidified slag particles 24 disposed thereon in order to seal the compartment 20 from the neck 26 of a slag tank assembly referred to in general by the reference numeral 28 disposed below the compartment 20.

The interior walls of the neck 26 diverge downwardly and the lower end of the neck 26 is telescoped into the upwardly opening neck 30 of the slag tank assembly top wall 32 and a water seal 34 is established between the lower end of the neck 26 and the neck 30.

The slag tank assembly 28 includes four depending cylindrical tank sections 36 opening upwardly into a cylindrical upper tank portion 38 immediately below the top wall 32 and the tank sections 36 depend downwardly from four equally peripherally spaced portions of the bottom wall 40 of the upper tank portion 38, the bottom wall 40 including a central raised cylindrical platform 42 about which the upper seat defining upper portions 44 of the tank sections 36 are disposed.

A closure 46 in the form of a float is provided and includes a seating surface 48 selectively sealingly engageable with any of the seat defining upper portions 44 of the tank sections 36. Further, the lower ends of the tank sections 36 are closed by means of inverted conical lower end portions 50 and each conical lower end portion 50 includes a door 52 formed therein through which solidified slag particles may be removed from the tank sections 36.

Any suitable means, such as a valve controlled outlet 54, may be provided for draining water from the upper tank portion 38 and suitable means, such as a water inlet conduit 56, may be provided for admitting water into the upper tank portion 38. Further, suitable means, not shown, is provided for admitting water into each tank section 36.

The closure 46 may be shifted from a position closing the upper portion of one tank section 36 to a position closing the upper portion of another tank section 36 merely by raising the level of water within the upper tank portion 38 whereby the closure 46 may be floated out of position engaged with a seat defining upper portion 44 of one of the tank sections 36. Then, the closure 46 may be floated into position above the seat defining upper portion 44 of a second tank section 36 and the level of water within the upper tank portion 38 may be lowered in order that the closure 46 may be lowered into position in seated engagement with the seat defining upper portion 44 of the second tank section 36.

The compartment 20 includes an access port 60 opening thereinto on the side thereof remote from the vertical tap hole 16 and solidified slag particles 62 may be dammed up in front of the vertical tap hole 16 through the port 60 and sand and/or solidified slag particles 24 may be placed on top of the gate 22 through the access port 60.

Referring now more specifically to FIGS. 1 and 3–6 of the drawings, it will be seen that four dozer blade assemblies referred to in general by the reference numeral 64 are operatively associated with the platform 42. Each dozer blade assembly includes a support 66 supported from the top wall 32, a double acting fluid cylinder 68 supported atop each support 66, a piston rod 70 depending from each cylinder 68 and extendible and retractable as well as rotatable relataive to the latter and a rotatable and vertically slotted frame 72 supported from each support 60 and oscillatable about an axis concentric with the corresponding piston rod 70. Each piston rod 70 includes a pair of diametrically opposite and outwardly projecting flanges 74 slidingly received in the slotted portions of the frame 72 and each frame 72 has the piston rod 76 of a second double acting fluid motor 78 pivotally anchored thereto as at 80, each double acting fluid motor 78 being oscillatably supported from the top wall 32 or other stationary support.

Figure 5:
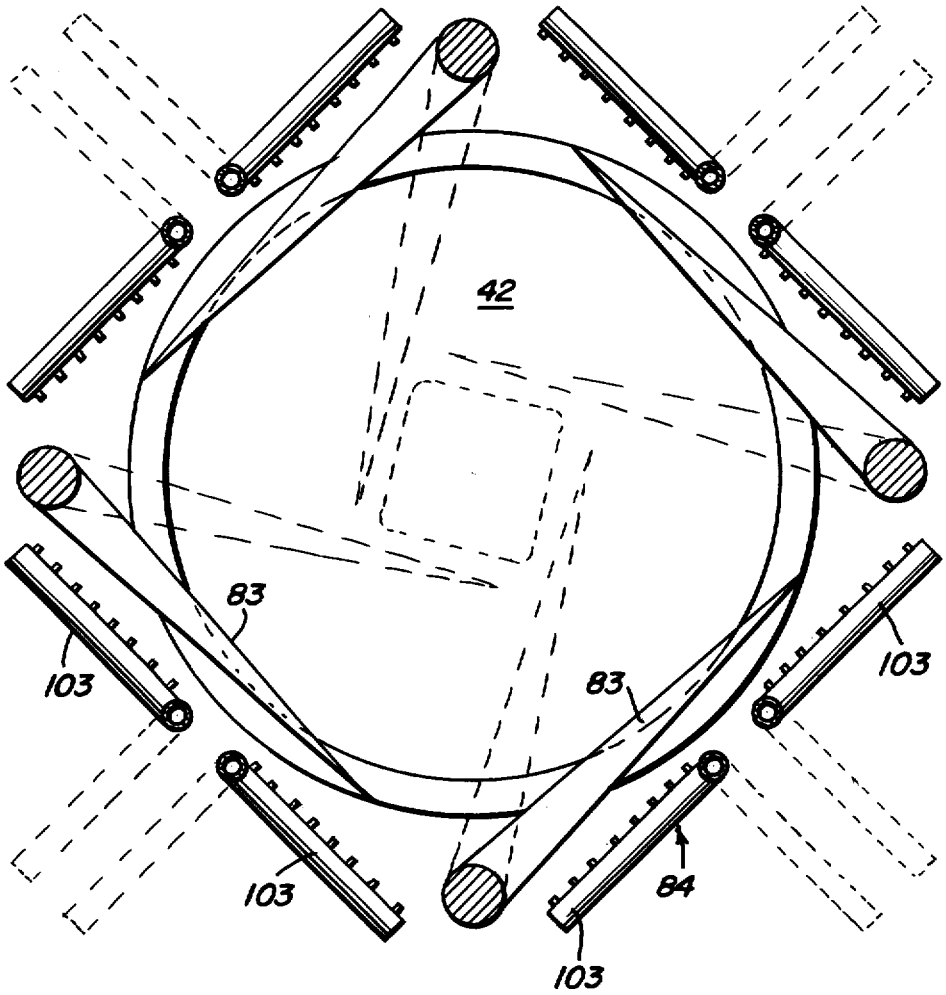
FIG. 5 is a fragmentary, enlarged, horizontal sectional view of the central portion of FIG. 2 and illustrating the positional relationship of the dozer blades and nozzle heads.

The lower end portions of the piston rods 70 project downwardly through openings 82 formed in the top wall 32 and terminate downwardly in horizontal dozer blades 83 which are swingable between the solid and phantom line positions thereof illustrated in FIG. 5 upon extension and retraction of the corresponding fluid cylinders 78. Further, the piston rods 70 may be extended and retracted in order to raise and lower the dozer blades 83.

In addition to the dozer blade assemblies 64, there is also provided four pairs of spray head assemblies 84 similar to the assemblies 64 and including supports 86. Cylinders 88 corresponding to the cylinders 68 are supported from the supports 86 and the cylinders 88 include depending piston rods 90 and oscillatable frames 92 corresponding to the frames 72 are supported from the supports 86 for oscillation about axes concentric with the piston rods 90. The piston rods 90 include diametrically opposite and outwardly projecting flanges 94 corresponding to the flanges 74 and slidably received in the slotted portions of the frames 72 and the piston rod portions 96 of double acting cylinders 98 are pivotally connected as at 100 to the frames 92 for oscillation thereof. The piston rods 90 include water inlet ports 101 opening thereinto to which a suitably controlled supply of water under pressure may be connected and the hollow piston rods 90 open downwardly into horizontal hollow sprayer heads 103. Accordingly, the sprayer heads 103 may be raised and lowered by actuation of the cylinders 88 and may be oscillated about vertical axes by actuation of the cylinders 98.

Figure 3:
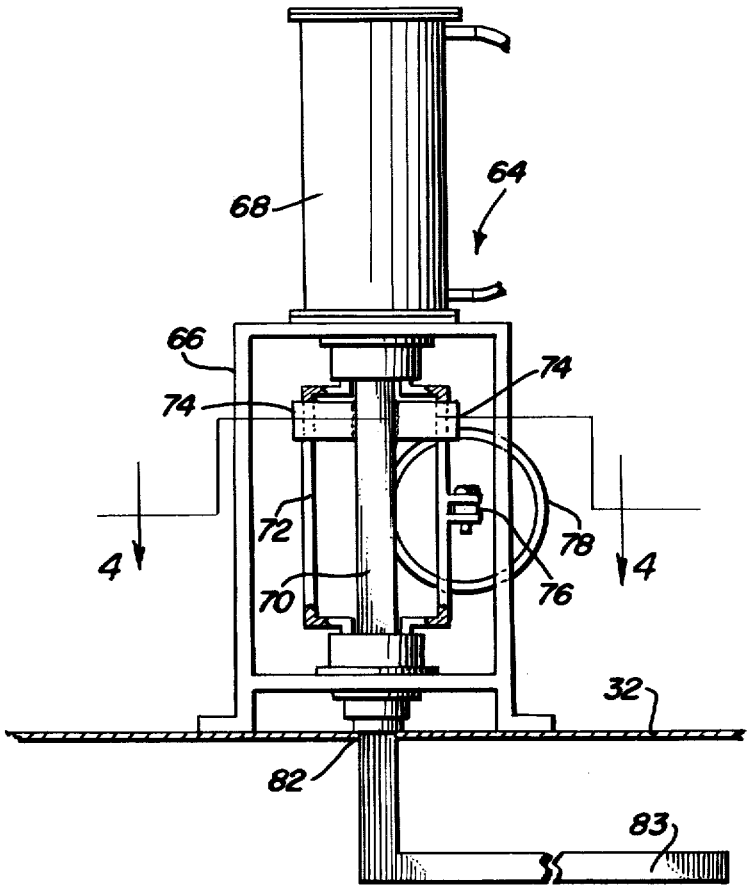
FIG. 3 is an enlarged, fragmentary, vertical sectional view illustrating one of the dozer blade support structures.
Figure 4:
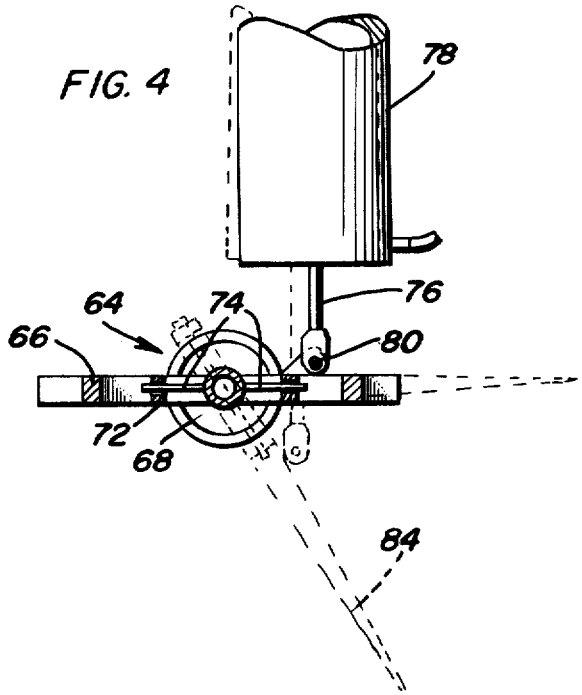
FIG. 4 is a horizontal sectional view taken substantially upon the plane indicated by the section line 4—4 of FIG. 3.
Figure 6:
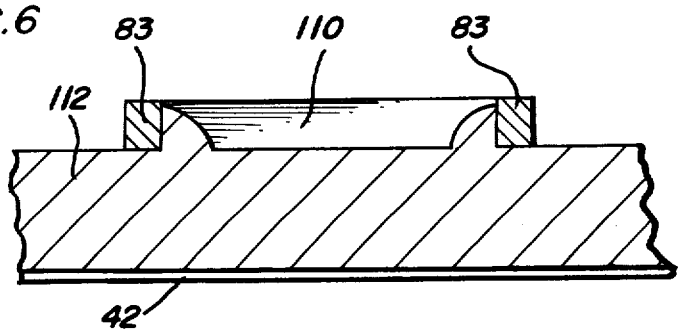
FIG. 6 is a fragmentary, enlarged, vertical sectional view illustrating the manner in which the dozer blades may be utilized to form a cavity in the central portion f the chilled particles bed for solid tapping.

In operation, the dozer blades 83 may be operated in a manner which is believed obvious from FIGS. 5 and 6 of the drawings in order to form a center cavity 110 on the platform 42 by scraping solidified slag particles across the top of the bed of solidified slag particles disposed on the platform 42. With the cavity 110 thus formed, the molten slag may be tapped from the boiler 10 into the cavity 110 for solid tapping and the solid solidified slag may be subsequently dozed off the platform 42 and into one of the tank sections 36 by the dozer blades 73. Although the dozer blades 73 are illustrated in FIG. 3 in phantom and solid lines relatively angularly displaced approximately 40°, it is to be noted that the dozer blades 83 may be angularly displaced through a range of approximately 90°.

If it is desired, the spray heads 84 are actuated during the process of a tapping operation whereby the slag dropping onto the bed 112 will be solidified and broken up into small particles.

Further, the water level within the upper tank portion 38 may be raised to a level above the platform 42 and in this manner the slag being tapped from the boiler 10 will fall down into the water above the platform and thereafter sink to the bed 112 on the platform 42. After the slag has solidified, it may be displaced from the platform 42 into one of the tank sections 36. When it is desired to empty one of the tank sections 36, the closure 46 is first floated into position over that tank section 36 lowered into position sealing the upper end of that tank section 36 and thereafter the door 52 of that tank section 36 may be opened in order to remove the solidified slag 120 from the lower end thereof. Of course, while one tank section 36 is sealed closed at its upper end by means of the closure 46, solidified slag may be deposited into any one of the other three tank sections 36 and each may be successively closed at its upper end by means of the closure 46 in order that solidified slag in the lower portion thereof may be removed through the associated door 52.

By providing the vertical tap hole 16, it is substantially impossible for the slag passing through the tap hole 16 to clog the latter. Further, by providing the gate 22, tight seal may be maintained between the compartment 20 and the neck 26.

Figures 7, 8:
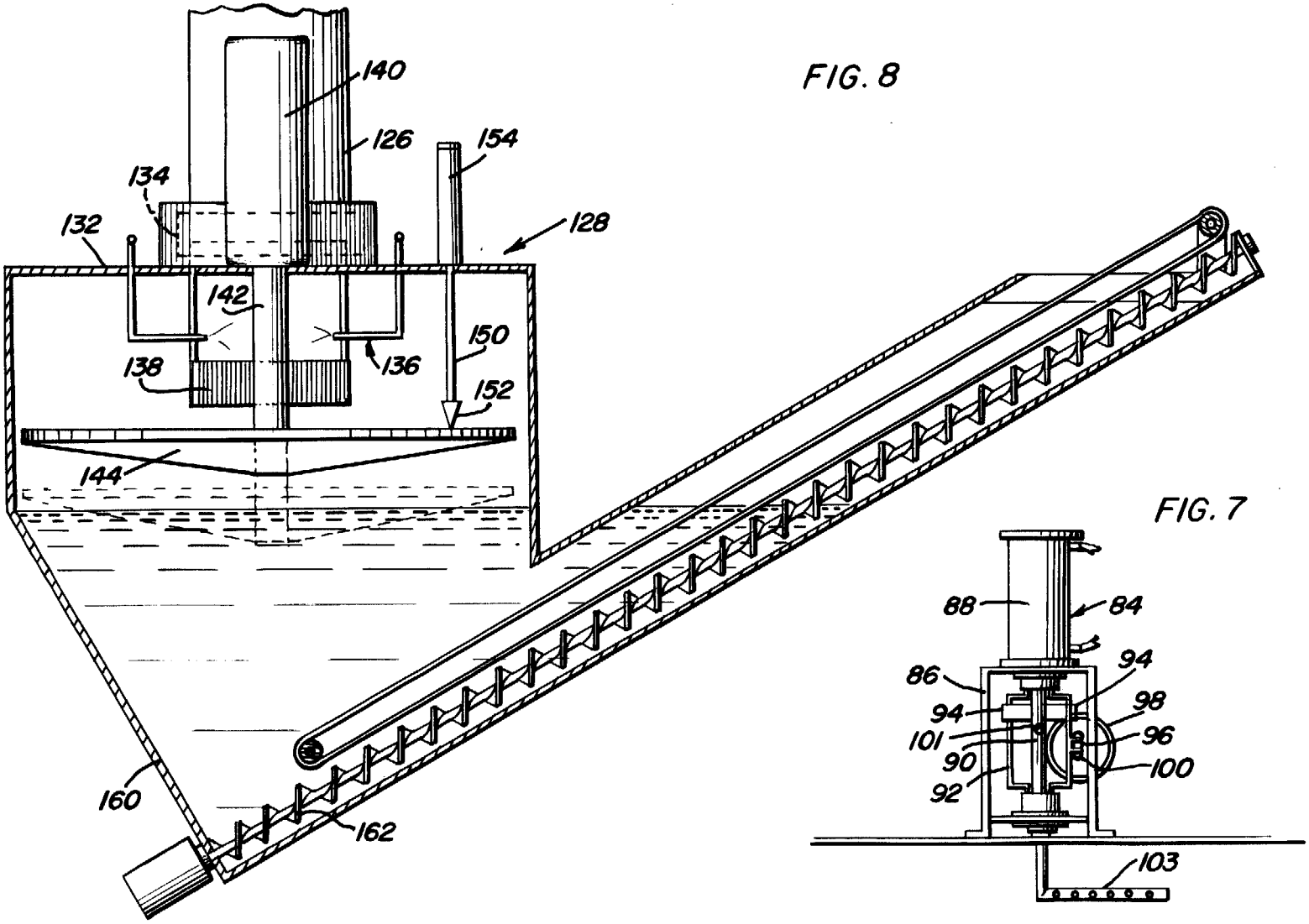
FIG. 7 is an enlarged, fragmentary, vertical sectional view similar to FIG. 3 but illustrating the support structure for the water nozzle heads.
FIG. 8 is a vertical sectional view illustrating a second form of multi-purpose slag system constructed in accordance with the present invention.
Figure 9:
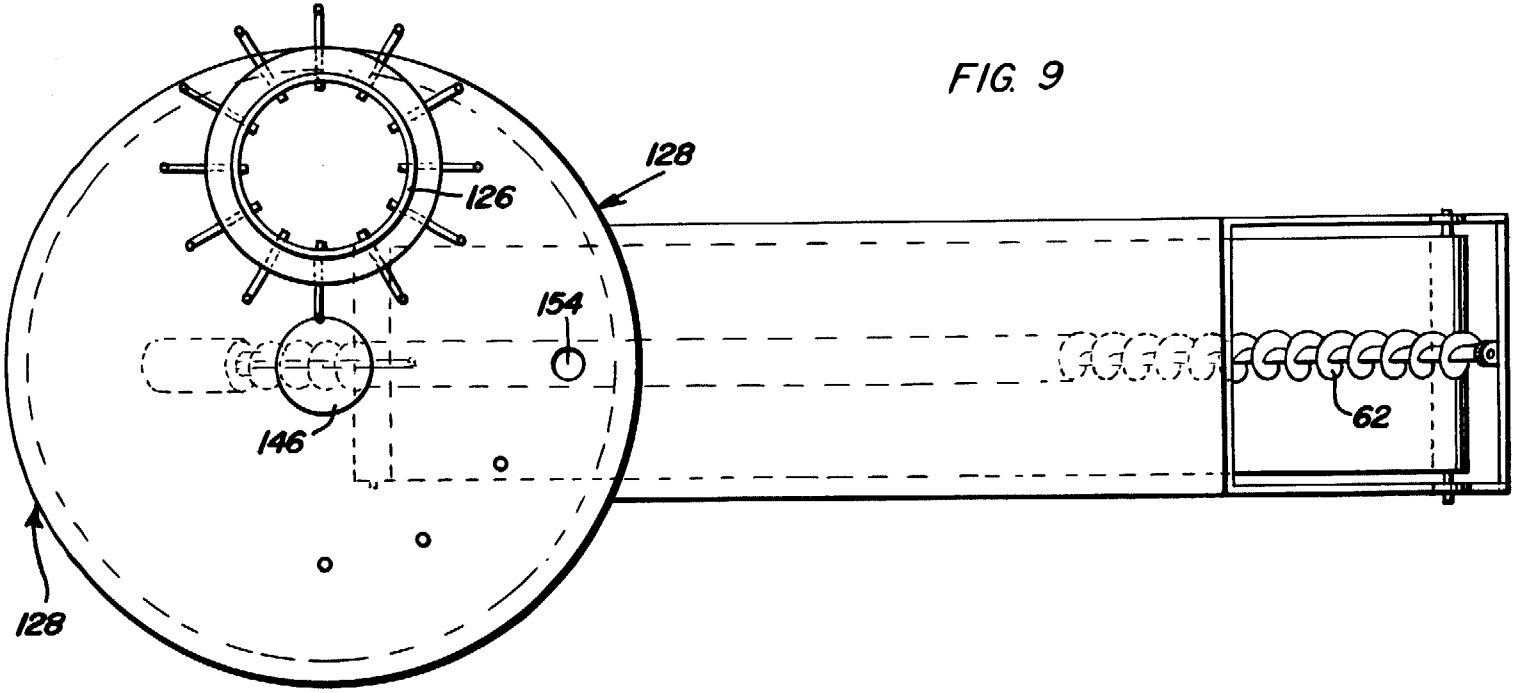
FIG. 9 is a top plan view of the assemblage illustrated in FIG. 8.

With attention now invited more specifically to FIGS. 8 and 9 of the drawings, there will be seen a modified form of slag tank assembly referred to in general by the reference numeral 128. The slag tank assembly 128 is similar to the slag tank assembly 28 in that it includes a neck 126 corresponding to the neck 26 and a water seal 134 corresponding to the water seal 34. Further, the upper end of the neck 126 is closed by means of a gate similar to the gate 22. Of course, the slag tank assembly 128 is utilized in conjunction with a boiler such as the boiler 10 including a raised central portion and a vertical tap hole leading into a compartment such as the compartment 20.

The slag tank assembly 128 includes a plurality of nozzle assemblies 136 corresponding to the nozzle assemblies 84 and a plurality of chain strands 138 are arranged in depending fashion in a circular pattern concentric with the neck 126. However, a turntable support structure 140 includes a powered rotatable and vertically shiftable central shaft 142 eccentrically disposed relative to the neck 126 and the lower end of the shaft 142 includes a horizontal circular turntable 144. One peripheral portion of the turntable 144 is disposed beneath the neck 126 and the nozzle assemblies 136 and the chain strands 138 are arranged in circular pattern concentric with the lower end of the neck 126.

The turntable support structure 140 is, of course, supported from the top wall 132 of the tank assembly 128 and the latter includes a vertically reciprocal piston rod 150 including a wedge-type lower end head 152. The rod 150 is carried by a double acting fluid cylinder 154 supported from the top wall 132 and the rod 150 extends and is slidable through the top wall 132. The spacing of the rod 150 from the center axis of the rotatable and vertically extendible and retractable support rod or column 142 of the turntable 144 is substantially identical to the spacing of the center of the neck 126 from the column 142. In this manner, the driven, rotary and extendible and retractable column 142 for the turntable 144 may be rotated at a speed whereby the molten slag deposited on the turntable 144 is formed into a ribbon, which ribbon is intermittently broken up into specified length ribbon sections by means of the wedge-shaped head 152 carried by the lower end of the rod 150 as the latter is reciprocated up and down by means of the cylinder 154. The broken slag ribbon sections may then be deflected off of the turntable 144 for dropping downward into the bottom 160 of the slag tank assembly 128 and upward movement therefrom by means of the auger conveyor 162. If it is desired, the slag tank assembly 128 may be provided with dozer blades such as the dozer blades 83 in order to deflect the solidified slag ribbon sections from the turntable 144. Otherwise, a simple stationary deflector portion (not shown) may be provided relative to which the turntable 144 may rotate for the purpose of deflecting solidified ribbon sections of slag from the turntable 144.

The water level within the upper portion of the tank assembly 128 may be raised and lowered as desired by admitting and draining, respectively, water into and from the tank assembly 138 by any suitable structure (not shown) provided for that purpose. After a suitable bed of solidified slag particles has been formed on the turntable 144, the water level may be lowered in order that the molten slag may fall directly onto slag particle bed on the periphery of the table 144 and be transformed into a ribbon for breaking up into predetermined length ribbon sections by the wedge-shaped head 152 at the lower end of the rod or shaft 150.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a wet bottom furnace including a bottom wall having an elevated section thereof defined by at least one upstanding wall portion defining an opening therethrough adjacent said bottom wall and defining a vertical tap hole in front of which granular material may be deposited for damming said vertical tap hole against the flow of molten slag therethrough from the interior of said furnace, said furnace bottom wall including wall means defining a downwardly opening compartment exteriorly of said furnace into which said tap hole opens from the interior of said furnace, said wall means including access means therein horizontally spaced from said tap hole and through which granular material may be inserted from exteriorly of said furnace and said downwardly opening compartment, through the latter and through said tap hole into said furnace for damming said floor inward of said tap hole, and also through which a tool may be inserted for raking up and withdrawing said granular material dam through said tap hole into said downwardly opening compartment.

2. The combination of claim 1 including an upwardly opening slag tank assembly disposed below and in vertical registry with said tap hole, said slag tank assembly including an upper portion and means for raising and lowering the level of water in said upper portion, said upper portion including a bottom structure, a central portion of said bottom structure being vertically registered with said tap hole, said tank assembly including a plurality of dependingly supported lower portions spaced about said central portion and opening upwardly through said bottom structure, each of said lower tank portions including slag removal means for removing solidified slag particles from the lower portion thereof, and a float-type closure within said tank upper portion and floatable therein into positions vertically registered with the open upper ends of said lower portions for lowering into sealed engagement with and closing the upper end of a selected lower portion upon lowering of the water level in said upper portion.

3. The combination of claim 1 including an upwardly opening slag tank assembly disposed below and in vertical registry with said tap hole, said slag tank assembly including means defining a horizontal support surface within said tank relative to which the level of water within the tank assembly may be adjustably elevated and depressed and adapted to have a solidified slag particle bed formed thereon.

4. The combination of claim 3 wherein said support surface comprises a selectively rotatable and elevatable and depressible turntable rotatable about an upstanding axis horizontally spaced from a vertical path into which said tap hole opens.

5. The combination of claim 4 wherein said support surface is centered relative to a vertical path into which said tap hole opens, water spray heads disposed about said path above said support surface and operative to direct jets of cooling water onto slag falling along said path toward said support surface.

6. In combination, a wet bottom furnace including a bottom wall having an elevated section thereof defined by upstanding peripheral wall portions projecting upwardly from said bottom wall and interconnected at their upper ends, one of said peripheral wall portions defining an opening therethrough adjacent said bottom wall and defining a vertical tap hole in front of which granular material may be deposited for damming said vertical tap hole against the flow of molten slag therethrough from the interior of said furnace, said furnace bottom wall including wall means defining a downwardly opening compartment exteriorly of said furnace into which said tap hole opens from the interior of said furnace, and closure means operatively associated with said wall means and shiftable into and out of position closing the lower portion of said compartment.

7. The combination of claim 6 wherein said closure means comprises shiftable bottom wall means for said compartment upon which sand may be placed for gas sealing the lower end of said compartment.

8. The combination of claim 7 wherein said wall means includes means defining an access port opening into said compartment remote from said tap hole from the exterior of said furnace below the bottom wall thereof and through which granular material may be introduced into and through said compartment and said tap hole for construction of a dam on said furnace bottom wall in front of said tap hole.

9. In combination, a wet bottom furnace including a bottom wall having an elevated section thereof defined by upstanding peripheral wall portions projecting upwardly from said bottom wall and interconnected at their upper ends, one of said peripheral wall portions defining an opening therethrough adjacent said bottom wall and defining a vertical tap hole in front of which granular material may be deposited for damming said vertical tap hole against the flow of molten slag therethrough from the interior of said furnace, an upwardly opening slag tank assembly disposed below and in vertical registry with said tap hole, said slag tank assembly including an upper portion and means for raising and lowering the level of water in said upper portion, said upper portion including a bottom structure, a central portion of said bottom structure being vertically registered with said tap hole, said tank assembly including a plurality of dependingly supported lower portions spaced about said central portion and opening upwardly through said bottom structure, each of said lower tank portions including slag removal means for removing solidified slag particles from the lower portion thereof, and a float-type closure within said tank upper portion and floatable therein into positions vertically registered with the open upper ends of said lower portions for lowering into sealed engagement with and closing the upper end of a selected lower portion upon lowering of the water level in said upper portion.

10. The combination of claim 9 including slag displacement means operatively associated with said central portion for laterally displacing solidified slag from said central portion toward the open upper end of a selected tank lower portion.

11. The combination of claim 10 wherein said slag displacement means includes means operative, given a bed of loose grandular solidified slag particles on said central portion, to displace spaced portions of the upper layer portions of said bed into a continuous upwardly projecting peripheral mound extending about a central area of said bed and defining an upwardly opening recess centrally on said bed for "solid slag tapping".

12. In combination with an upstanding tubular neck downwardly through which molten slag may controllably be dropped, an upwardly opening slag tank assembly disposed below and in vertical registry with said neck, said slag tank assembly including an upper portion and means for raising and lowering the level of water in said upper portion, said upper portion including a bottom structure, a central portion of said bottom structure being vertically registered with said tap hole, said tank assembly including a plurality of dependingly supported lower portions spaced about said central portion and opening upwardly through said bottom structure, each of said lower tank portions including slag removal means for removing solidified slag particles from the lower portion thereof, and a float-type closure within said tank upper portion and floatable therein into positions vertically registered with the open upper ends of said lower portions for lowering into sealed engagement with and closing the upper end of a selected lower portion upon lowering of the water level in said upper portion.

13. The combination of claim 12 including slag displacement means operatively associated with said central portion for laterally displacing solidified slag from said central portion toward the open upper end of a selected tank lower portion.

14. The combination of claim 13 wherein said slag displacement means includes means operative, given a bed of loose grandular solidified slag particles on said central portion, to displace spaced portions of the upper layer portions of said bed into a continuous upwardly projecting peripheral mound extending about a central area of said bed and defining an upwardly opening recess centrally on said bed for "solid slag tapping".

15. In combination, a wet bottom furnace including a bottom wall having an elevated section thereof defined by upstanding peripheral wall portions projecting upwardly from said bottom wall and interconnected at their upper ends, one of said peripheral wall portions defining an opening therethrough adjacent said bottom wall and defining a vertical tap hole in front of which granular material may be deposited for damming said vertical tap hole against the flow of molten slag therethrough from the interior of said furnace, an upwardly opening slag tank assembly disposed below and in vertical registry with said tap hole, said slag tank assembly including means defining a horizontal support surface within said tank relative to which the level of water within the tank assembly may be adjustably elevated and depressed and adapted to have a solidified slag particle bed formed thereon.

16. The combination of claim 15 wherein said support surface is centered relative to a vertical path into which said tap hole opens.

17. The combination of claim 15 wherein said support surface comprises a selectively rotatable and elevatable and depressible turntable rotatable about an upstanding axis horizontally spaced from a vertical path into which said tap hole opens.

18. The combination of claim 17 including vertically reciprocal impact means spaced horizontally from said axis a distance generally equal to the horizontal spacing between said axis and vertical path and operative to break up a solidified slag ribbon supported on said turntable.

19. The combination of claim 18 including water spray heads disposed about said path above said turntable and operative to direct jets of cooling water onto slag falling along said path toward said turntable.

20. The combination of claim 19 including means supporting said spray heads for vertical shifting and angular displacement relative to said tank assembly along and about upstanding axes spaced about said path.

21. The combination of claim 15 wherein said support surface is centered relative to a vertical path into which said tap hole opens, water spray heads disposed about said path above said support surface and operative to direct jets of cooling water onto slag falling along said path toward said support surface.

22. The combination of claim 21 including means supporting said spray heads for vertical shifting and angular displacement relative to said tank assembly along and about upstanding axes spaced about said path.

* * * * *